US007891432B2

(12) United States Patent
Assal

(10) Patent No.: US 7,891,432 B2
(45) Date of Patent: Feb. 22, 2011

(54) APPARATUS AND METHODS FOR SETTING ONE OR MORE PACKERS IN A WELL BORE

(75) Inventor: Anwar Ahmed Maher Assal, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 338 days.

(21) Appl. No.: 12/037,136

(22) Filed: Feb. 26, 2008

(65) Prior Publication Data

US 2009/0211769 A1 Aug. 27, 2009

(51) Int. Cl.
*E21B 33/12* (2006.01)
*E21B 34/08* (2006.01)

(52) U.S. Cl. ..... 166/387; 166/148; 166/321; 166/325

(58) Field of Classification Search ..... 166/387, 166/374, 148, 321, 325
See application file for complete search history.

(56) References Cited

U.S. PATENT DOCUMENTS

| | | | | |
|---|---|---|---|---|
| 3,316,969 | A * | 5/1967 | Smith | 166/387 |
| 3,606,924 | A * | 9/1971 | Malone | 166/187 |
| 4,314,608 | A | 2/1982 | Richardson | |
| 4,420,159 | A * | 12/1983 | Wood | 277/333 |
| 4,586,526 | A * | 5/1986 | Reardon | 137/70 |
| 4,653,588 | A * | 3/1987 | White | 166/374 |
| 4,655,286 | A * | 4/1987 | Wood | 166/285 |
| 5,549,165 | A * | 8/1996 | Brooks | 166/386 |
| 5,615,741 | A * | 4/1997 | Coronado | 166/387 |
| 6,622,794 | B2 | 9/2003 | Zisk | |
| 6,938,698 | B2 | 9/2005 | Coronado | |
| 6,959,763 | B2 | 11/2005 | Hook | |
| 6,977,367 | B2 | 12/2005 | Tubel | |
| 6,994,170 | B2 | 2/2006 | Echols | |
| 7,191,844 | B2 | 3/2007 | Kenison | |
| 7,240,739 | B2 | 7/2007 | Schoonderbeek | |
| 7,273,107 | B2 | 9/2007 | Hiron | |
| 7,334,650 | B2 | 2/2008 | Giroux | |
| 7,337,840 | B2 | 3/2008 | Penno | |
| 7,419,002 | B2 * | 9/2008 | Dybevik et al. | 166/205 |
| 7,472,746 | B2 * | 1/2009 | Maier | 166/129 |
| 2002/0157837 | A1 | 10/2002 | Bode | |

(Continued)

OTHER PUBLICATIONS

Reslink, ResFlow(TM) Well Production Management System, product brochure, 2005.

(Continued)

*Primary Examiner*—Jennifer H Gay

(57) ABSTRACT

Apparatus and methods for setting one or more packers in a well bore. A check valve is provided that controls flow of fluids into and out of an inflow control device on a base pipe in a production string. With the check valve in the closed position, a setting ball is passed through the inside of the base pipe and sealing seats in a seat sub, thereby preventing fluid from flowing out of the end of the base pipe. Increasing the pressure inside the base pipe causes the packers to set. Decreasing the pressure inside the base pipe creates a differential between the pressure inside the base pipe and the pressure of the surrounding reservoir that is sufficient to overcome the bias on the check valve and move the check valve into the open position, thereby allowing reservoir fluid to flow into the base pipe for production.

22 Claims, 7 Drawing Sheets

U.S. PATENT DOCUMENTS

| | | | | |
|---|---|---|---|---|
| 2003/0029614 | A1 | 2/2003 | Michel | |
| 2004/0055758 | A1 | 3/2004 | Brezinski | |
| 2005/0139354 | A1 | 6/2005 | Salamat | |
| 2006/0113089 | A1 * | 6/2006 | Henriksen et al. | 166/386 |
| 2006/0118296 | A1 | 6/2006 | Dybevik | |
| 2007/0012453 | A1 | 1/2007 | Coronado | |
| 2008/0041588 | A1 | 2/2008 | Richards | |

OTHER PUBLICATIONS

Schlumberger, Openhole Zonal Isolation Permanent Packer, product brochure, Dec. 2006.

* cited by examiner

APPARATUS AND METHODS FOR SETTING ONE OR MORE PACKERS IN A WELL BORE

FIELD

The present application relates to the oilfield industry and specifically to apparatus and methods for setting one or more packers in a well bore completion assembly.

BACKGROUND

In the oilfield industry, well bore completion assemblies typically include a series of packers that are spaced apart on a completion string to isolate a corresponding series of reservoir production zones. Once the packers are situated in the desired downhole position, a setting tool, commonly referred to as a wash string, is run inside the completion string to set each packer. The setting tool must be positioned next to each packer, one-by-one, to mechanically set the packer by applying hydrostatic or hydraulic pressure across the packer's setting port. Typical openhole completion assemblies include numerous packers and therefore the setting tool must be run, repositioned and pressurized numerous times to set all of the packers in the assembly. This is very inefficient and time consuming, especially when the same setting procedure must be carried out for a large number of well bores.

In addition, setting tools are subject to frequent mechanical failures. For example pressure leaks often occur in the wash string, and wash cups that straddle the setting ports of the packers frequently leak or otherwise fail. Indicating collets are also subject to failure. When there is a failure, it is typically necessary to remove the entire setting tool from the well and conduct some sort of repair. This is very time consuming and costly. It is also often difficult to determine the source of the failure. For example, typical wash strings are very difficult to pressure test because the strings are very long and have a large number of joints. This results in further inefficiency.

SUMMARY

The present application provides improved apparatus and methods for setting one or more packers in a well bore. The illustrated examples allow for setting of a plurality of downhole packers in a short period of time and without using a wash string, wash cups, or other setting tool that is subject to mechanical failure.

In one example, a check valve is provided that controls flow of fluids into and out of an inflow control device on a base pipe in the production string. The check valve is movable from a closed position wherein flow of fluids from the base pipe to the reservoir via the inflow control device is prevented, to an open position wherein flow of reservoir fluids into the base pipe via the inflow control device is allowed. The check valve is biased into the closed position however it is moved into the open position when the pressure of the reservoir fluid is greater than the pressure inside the base pipe by a predetermined amount. With the check valve in the closed position, a setting ball is passed through the inside of the base pipe and sealingly seats in a seat sub, thereby preventing fluid from flowing out of the end of the base pipe. Increasing the pressure inside the base pipe while the check valve is in the closed position and the setting ball is seated in the seat sub increases the pressure on setting ports for the respective packers and thus causes the packers to set. Thereafter, decreasing the pressure inside the base pipe creates a differential between the pressure inside the base pipe and the pressure of the surrounding reservoir that is sufficient to overcome the bias on the check valve and move the check valve into the open position, thereby allowing reservoir fluid to flow into the base pipe for production.

BRIEF DESCRIPTION OF THE DRAWINGS

The best mode of carrying out the invention is described with reference to the following drawing Figures.

DETAILED DESCRIPTION OF THE DRAWINGS

In the following description, certain terms have been used for brevity, clearness, and understanding. No unnecessary limitations are to be implied therefrom beyond the requirement of the prior art because such terms are used for descriptive purposes and are intended to be broadly construed. The different configurations and method steps described herein may be used alone or in combination with other configurations, systems and method steps. It is to be expected that various equivalents, alternatives and modifications are possible within the scope of the appended claims.

Figure 1:
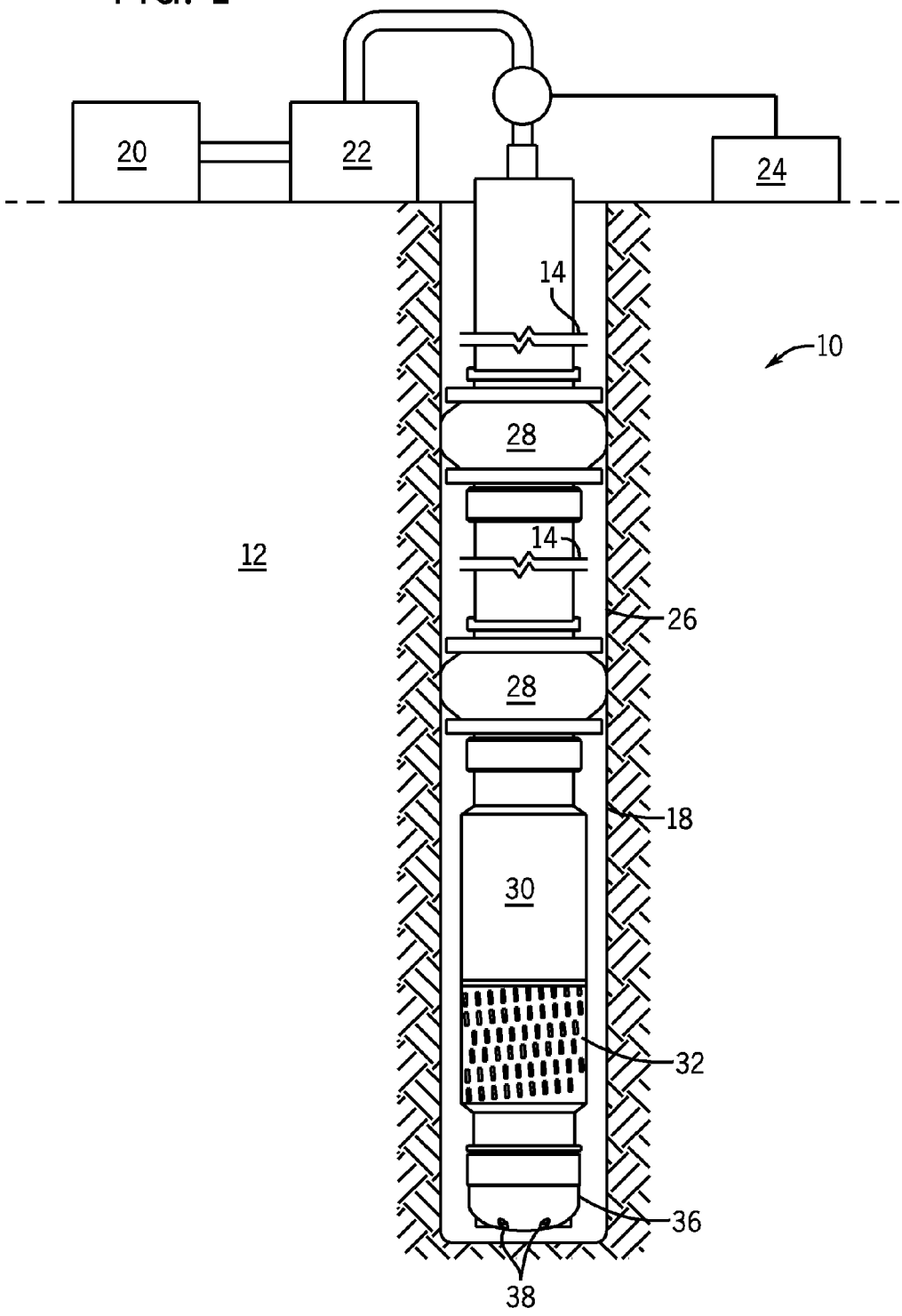
FIG. 1 is a schematic view showing a well bore completion assembly.

FIG. 1 depicts a well bore completion assembly 10 installed in an underground reservoir 12. The well bore completion assembly is of variable length as shown schematically by break lines 14. As such, the completion assembly 10 can include numerous structures not shown in the drawings. The completion assembly 10 can also extend at an angle or horizontal to the surface 16 and is shown in vertical orientation for descriptive purposes only.

The completion assembly 10 includes a substantially unperforated base pipe 18 connected to above-ground production equipment 20, 22 and control equipment 24. The completion assembly illustrated in FIG. 1 is an open hole completion that extends into and is sealed by a plurality of packers 28 to the inner surface of the well bore 26. As shown by break lines 14, the completion assembly 10 can include numerous packers 28 that are spaced apart on the base pipe 18 to isolate a corresponding series of reservoir production zones. As known in the art, the completion assembly 10 is run into the well bore 26 and thereafter, packers 28 are set to isolate the respective production zones. The packers 28 may be hydraulic, hydrostatic swell packers, or any other type of packer capable of actuation based upon an increase in pressure inside the base pipe 18. For example a suitable packer is the openhole zonal isolation (OZI) permanent packer manufactured by Schlumberger.

A shroud or screen jacket 30 and an associated sand screen 32 are provided on the outer circumference of the base pipe 18. Each section of base pipe 18, as separated by the spaced apart packers 28 typically includes the shroud 30 and sand screen 32 which facilitate inflow of reservoir fluids into the base pipe 18, as farther described hereinbelow.

Figure 2:
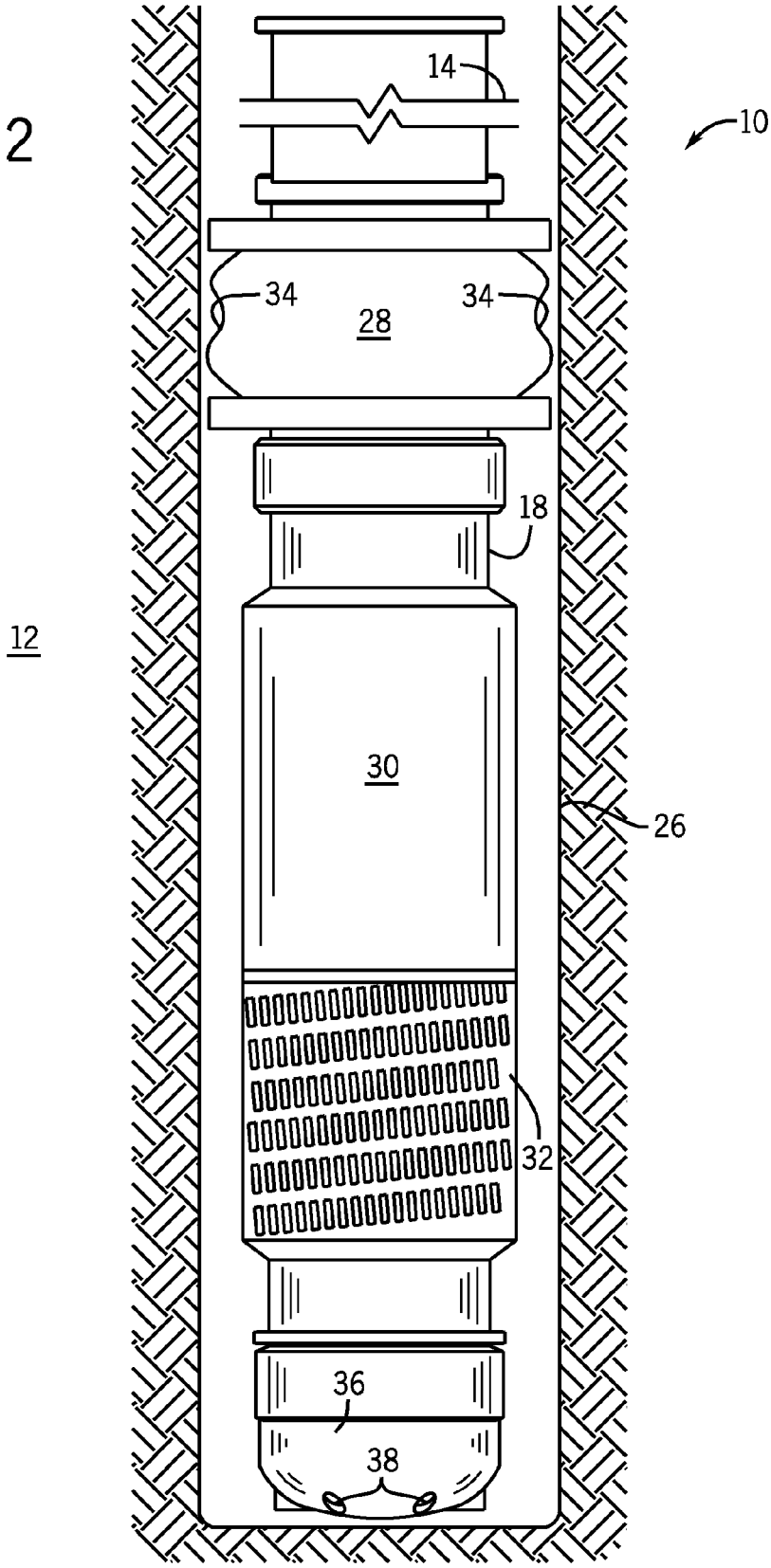
FIG. 2 is partial view of the assembly of FIG. 1.

FIG. 2 depicts the lowermost section of the completion assembly 10 just after insertion into the well bore 26. Packer 28 has not yet been set against the inside of the well bore 26 and therefore there is space between the well bore 26 and the outer packer surface 34. The sand screen 32 is positioned beneath the shroud 30, however as will be recognized in the art, the sand screen 32 may alternately be positioned above the shroud 30. A wash down shoe 36 is connected to the lowermost end of the base pipe 18. Wash down shoe 36 includes outlet holes 38 for emitting tubing and reservoir flush prior to setting of the packers 28 and initiation of production.

Figure 3:
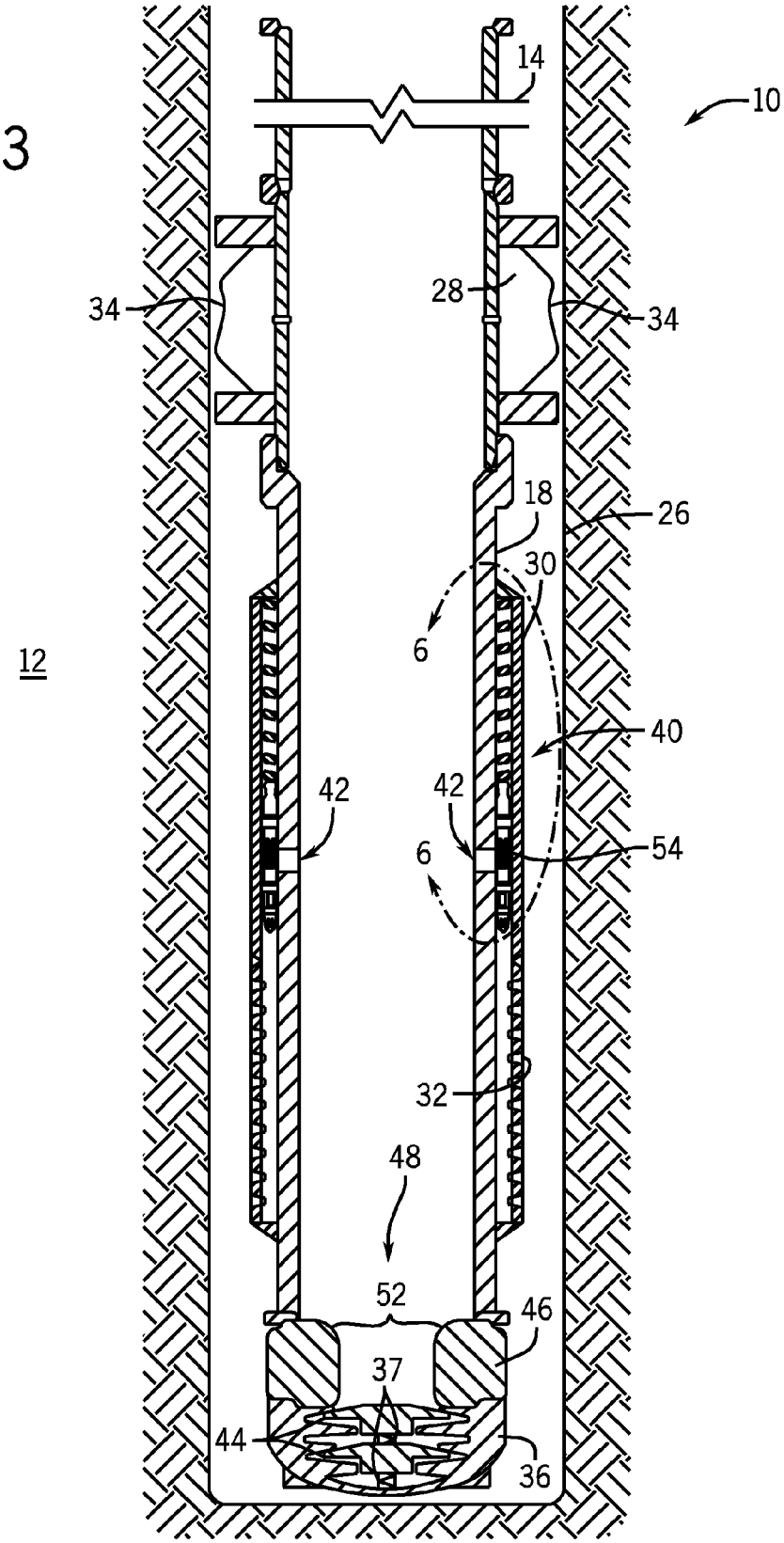
FIG. 3 is a sectional view of the view shown in FIG. 2.

FIG. 3 is a sectional view of the lowermost portion of the completion assembly 10 shown in FIG. 2. As is conventional in the art, each section of the completion assembly 10 includes an inflow control device 40 which throttles radially inflowing reservoir fluids through the base pipe 18 to effect a relatively stable and predictable fluid pressure drop at any stable fluid flow rate during production the well. In the depicted example, the inflow control device 40 includes at least one nozzle 42 extending through the base pipe 18. Alternatively, the inflow control device 40 can include any one of a number of nozzles, plugs and/or orifices, as described in pending U.S. patent application Ser. No. 10/472,727 assigned to Schlumberger, the specification of which is incorporated herein by reference.

Figure 8:
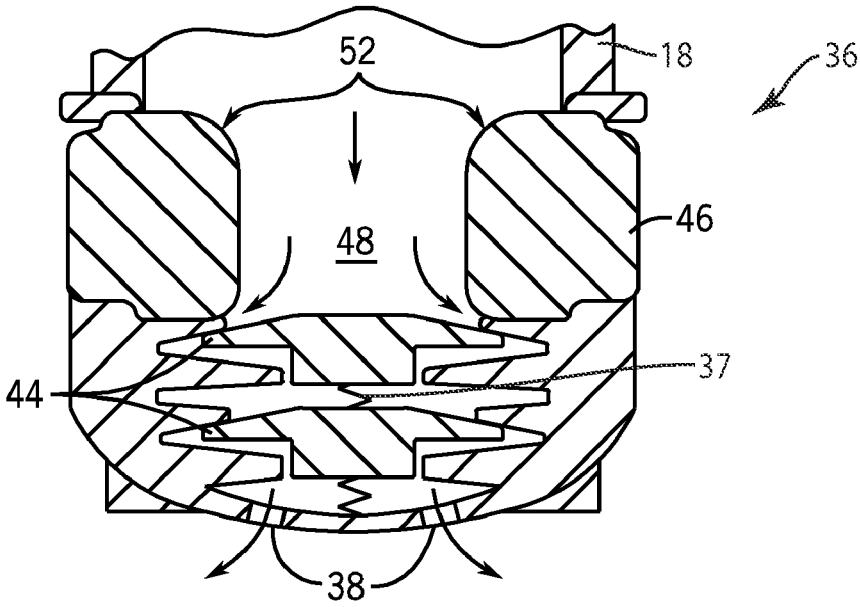
FIG. 8 is a view of Section 8-8 taken in FIG. 5.

FIGS. 3 and 8 further show details of the wash down shoe 36, which includes flapper valves 44 that are biased into a closed position (as shown) by a spring 37 or other biasing means. The flapper valves 44 and bias means function to seal the lowermost end of the completion assembly 10 during production. The flapper valve 44 is biased into the sealed position and opens upon an increase in pressure inside the base pipe 18 beyond a predetermined value. The wash down shoe 36 therefore facilitates circulation of fluid inside of the base pipe 18 and out into the surrounding open hole well bore 26 prior to setting of the packers 28. A ball seat sub 46 is provided with the wash down shoe 36. The ball seat sub 46 defines an inner sealing passage 48 for receiving and sealing with a plug, such as a setting ball 50 (see FIG. 4). The ball seat sub 46 includes tapered edge portions 52 which function to funnel the setting ball 50 into sealing relationship with the sealing passage 48.

Figure 6:
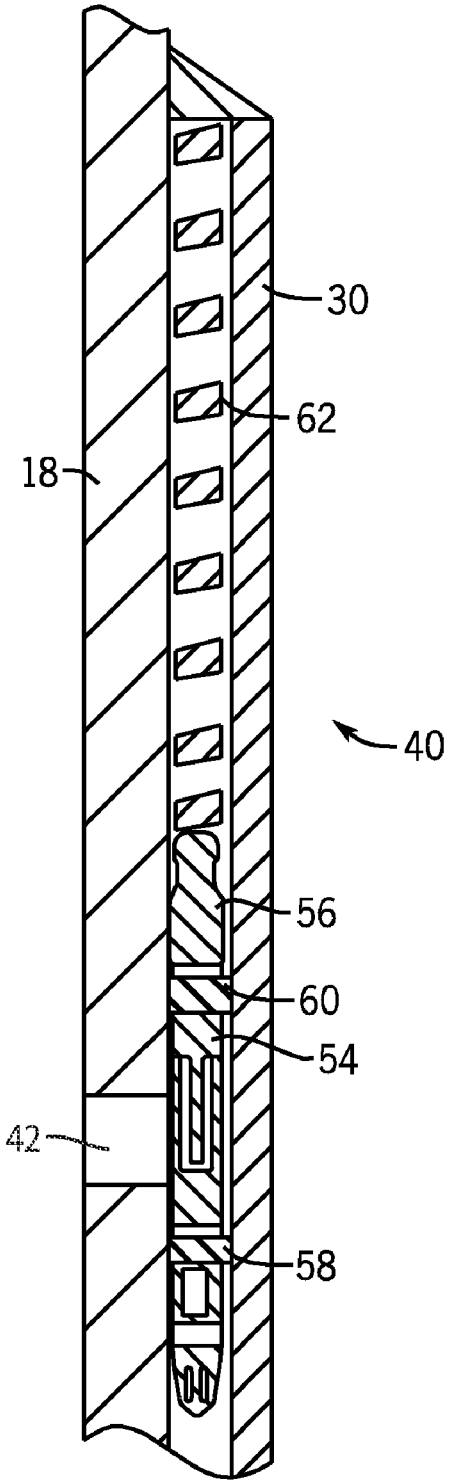
FIG. 6 is a view of Section 6-6 taken in FIG. 3.
Figure 7:
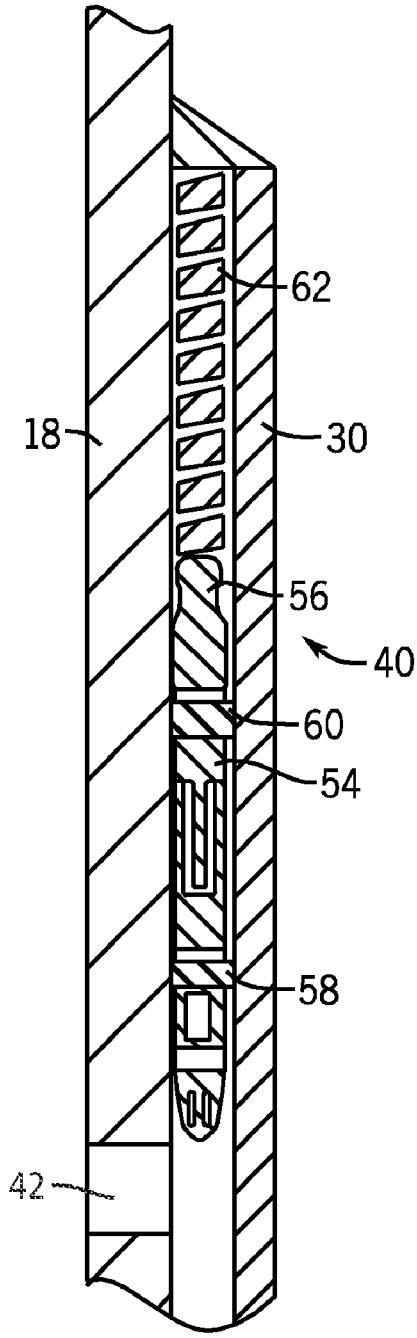
FIG. 7 is a view of Section 7-7 taken in FIG. 5.

As shown in FIGS. 3, 6 and 7, a check valve 54 is provided on the base pipe 18 and configured to control flow of reservoir fluid into the base pipe 18 by sealing and unsealing the inflow control device 40, which in the example shown includes opposing nozzles 42. The depicted arrangement is merely an example however and the check valve 54 may be alternatively constructed to seal any of the various inflow control devices 40 currently known and foreseeable in the art, including but not limited to devices incorporating a different number and/or configuration of nozzles and/or orifices in the base pipe 18, or in any other type of inflow conveyance structure device associated with the completion assembly 10. That is, the actual makeup of the check valve 54 and inflow control device 40 are not critical to the inventive concepts described herein. Any number of configurations and combinations of check valves 54 and inflow control devices 40 could be provided to effectively prevent the ingress and/or egress of fluid to and from the base pipe 18.

Figure 9:
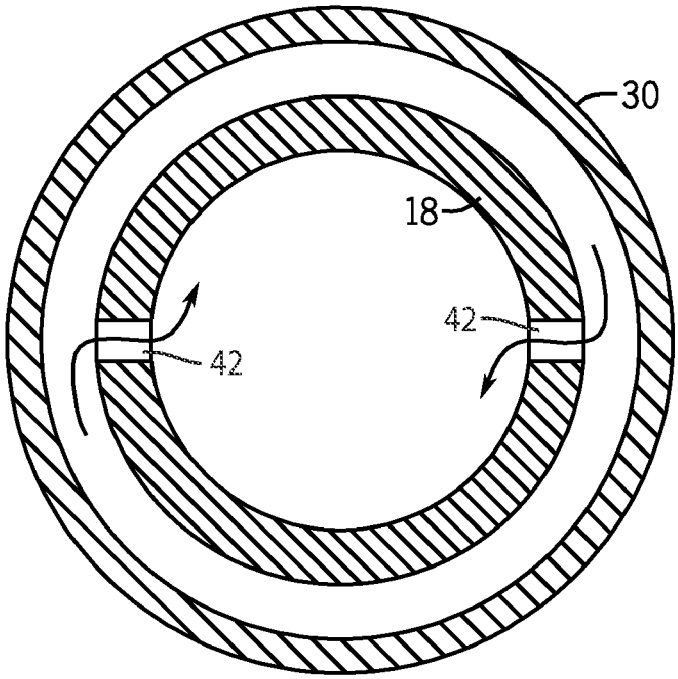
FIG. 9 is a view of Section 9-9 taken in FIG. 5.

As shown most clearly in FIGS. 6 and 7, the example provided is a check valve 54 that includes a collar 56 on the outer circumference of the base pipe 18. A pair of sealing members 58, 60 is provided on the collar 56 and forms a seal between the base pipe 18 and shroud 30. A spring 62 biases the collar 56 and sealing members 58, 60 into a closed position, shown in FIG. 6, wherein the scaling members 58, 60 seal on either side of the nozzles 42 to prevent passage of fluid into or out of the nozzle 42. As shown in FIG. 7, the collar 56 and sealing members 58, 60 are movable into an open position by compressing the spring 62. In the open position, the nozzles 42 allow flow of reservoir fluid into the base pipe 18, as shown in FIG. 9.

Figure 4:
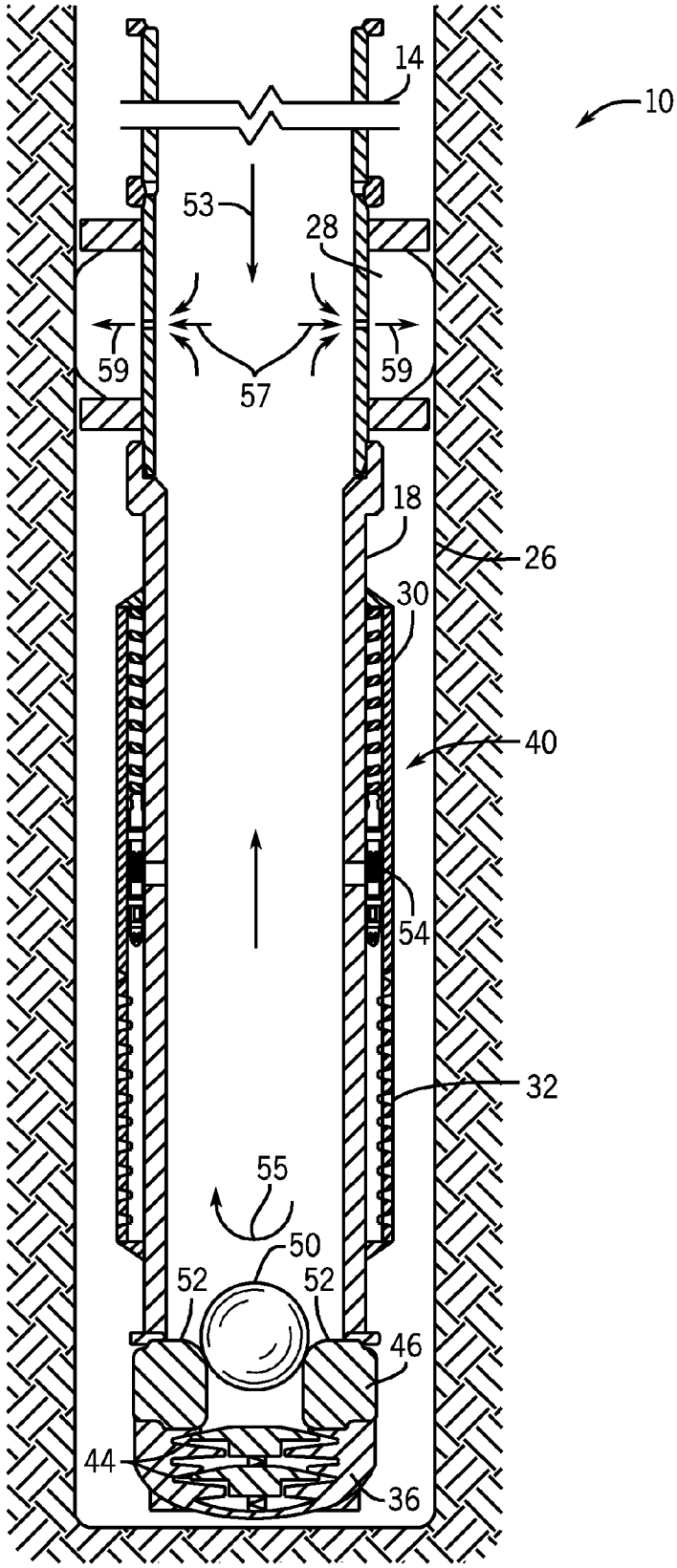
FIG. 4 is a sectional view of the assembly showing a packer being set.

With reference now to FIG. 4, the check valve 54, ball seat sub 46 and setting ball 50 facilitate setting of any number of packers 28 on the string 10 without the use of conventional setting tools. With the check valves 54 biased into the closed position by respective springs 62, the setting ball 50 is inserted into the base pipe 18 and pumped or otherwise caused to travel down through the base pipe 18 in the direction shown by arrow 53 to the ball seat sub 46. Gravity and/or fluid pressure causes the setting ball 50 seat in and seal with the ball seat sub 46 and thus prevent flow of fluid out of the bottom of the completion assembly 10 via the wash down shoe 36 as shown by arrow 55. The setting ball 50 and ball seat sub 46 are preferably constructed of metal and therefore form a metal-to-metal seal. However the setting ball 50 and ball seat sub 46 could consist of any other suitable material for forming a seal such as plastic, and the like. The check valves 54 associated with each inflow control device 40 also prevent flow of fluid out of the inflow control device 40. Thereafter, increasing pressure inside the base pipe 18 actuates conventional setting ports 64 associated with the packers 28 as shown by arrows 57 and causes the packers 28 to set as shown by arrows 59.

Figure 5:
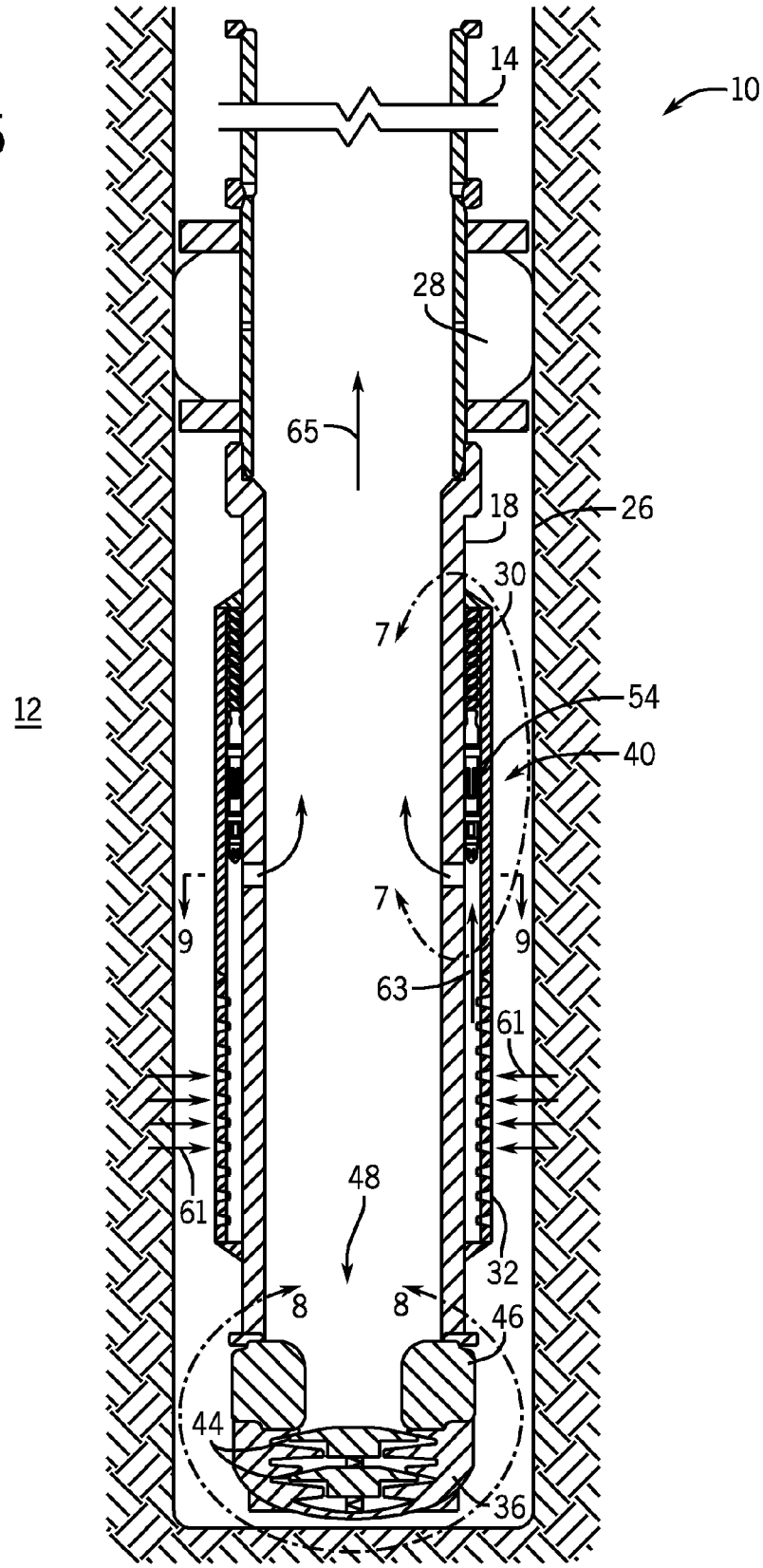
FIG. 5 is a sectional view of the assembly during production.

As shown in FIG. 5, after the packers 28 are set, the well is unloaded according to conventional methods, which causes the pressure inside of the base pipe 18 to be less than the pressure of the surrounding reservoir fluid. After this pressure differential becomes greater than the bias of the respective springs 62, the reservoir fluid pushes the collars 56 and associated sealing members 58 into the open position shown for example in FIG. 7 and reservoir fluid is permitted to flow through the inflow control devices 40 as shown by arrows 61, 63, 65 and production is commenced in conventional manner.

What is claimed is:

1. Apparatus for use in a well bore extending into an underground reservoir, the apparatus comprising:

a base pipe;

a packer configured to set upon an increase in pressure in the base pipe;

an inflow control device configured to control flow of fluid into the base pipe from the underground reservoir, the inflow control device comprising a check valve that is movable from a closed position wherein flow of fluid into the base pipe from the underground reservoir is prevented to an open position wherein flow of fluid into the base pipe from the underground reservoir is allowed;

a plug that seats in the apparatus to prevent fluid from flowing through the base pipe;

wherein increasing the pressure inside the base pipe while the plug is seated and the check valve is in the closed position causes the packer to set;

wherein decreasing the pressure in the base in se to an amount that is less than the pressure of the fluid in the underground reservoir causes the pressure of the fluid in the underground reservoir to move the check valve from the closed position to the open position.

2. The apparatus of claim 1, further comprising:

a seat sub coupled to the base pipe and sized to receive and form a seal with the plug, the seal preventing fluid from flowing through a downhole end of the base pipe.

3. The apparatus of claim 2, wherein the plug is sized smaller than the inner diameter of the base pipe such that the plug can move through the inside of the base pipe.

4. The apparatus of claim 3, wherein the plug comprises a setting ball.

5. The apparatus of claim 2, wherein the seat sub is formed in a wash down shoe.

6. The apparatus of claim 1, further comprising a setting port, the setting port facilitating setting of the packer when pressure inside the base pipe exceeds a predetermined value.

7. The apparatus of claim 1, wherein the inflow control device comprises at least one nozzle.

8. The apparatus of claim 1, wherein the check valve is biased into the closed position by a spring.

9. The apparatus of claim 1, wherein the inflow control device comprises a collar on an outer circumference of the base pipe, the collar being movable relative to the base pipe from the closed to the open position.

10. The apparatus of claim 9, wherein the collar comprises a pair of sealing members that seal on either side of the inflow control device when the collar is in the closed position.

11. The apparatus of claim 10, further comprising a shroud, the shroud extending over the inflow control device and defining a space through which the collar moves from the closed to open position.

12. The apparatus of claim 11, wherein at least one of the pair of sealing members seals the space between the base pipe and the shroud.

13. The apparatus of claim 11, wherein the pair of sealing members seal the space between the base pipe and the shroud.

14. The apparatus of claim 1, wherein the packer is one of a plurality of packers configured to set when pressure inside the base pipe exceeds a predetermined value.

15. The apparatus of claim 1, comprising wherein the packer is one of a plurality of packers configured to set when the pressure inside the base pipe exceeds a predetermined value;

wherein the inflow control device is one of a plurality of inflow control devices configured to control flow of reservoir fluid into the base pipe; and wherein each inflow device in the plurality comprises a check valve that is movable from the closed position to the open position;

wherein each check valve is biased into the closed position; and wherein the bias on each check valve is overcome and the check valves are moved into the open position when the pressure of the surrounding reservoir fluid is greater than the pressure inside the base pipe by a predetermined amount.

16. A method for setting one or more packers in a well bore completion string, the completion string having a base pipe and at least one packer that sets when pressure inside the base pipe exceeds a predetermined value, method comprising the steps of:

preventing flow of fluid through the base pipe;

increasing pressure inside the base pipe above the predetermined value to actuate and set the at least one packer while flow through the base pipe is prevented;

decreasing pressure inside the base pipe to allow a positive differential of pressure of the surrounding reservoir fluid relative to pressure inside the base pipe to move a check valve from a closed position wherein flow of reservoir fluids into the base pipe is prevented into an open position wherein flow of the reservoir fluids into the base pipe is allowed.

17. The method of claim 16, further comprising the steps of:

plugging an end of the base pipe;

increasing the pressure inside the base pipe while the check valve is in the closed position and the end of the base pipe is plugged, wherein the increase in pressure causes the packer to set.

18. The method of claim 17, further comprising the steps of providing a seat sub on the base pipe, the seat sub sized to receive and form a seal with a plug, the seal preventing reservoir fluid from flowing through an end of the base pipe via the seat sub; and plugging the seat sub with the plug.

19. The method of claim 18, wherein the plug is sized smaller than the diameter of the base pipe and wherein the method further comprises the step of passing the plug into the base pipe such that the plug moves through the base pipe and seals with the seat sub.

20. The method of claim 17, further comprising the step of decreasing the pressure inside the base pipe to create a differential between the pressure inside the base pipe and the pressure of the surrounding reservoir that is large enough to move the check valve against a bias holding the check valve in the closed position and into the open position and thereby allowing reservoir fluid to pass into the base pipe via the inflow control device.

21. Apparatus for use in a well bore extending into an underground reservoir, the apparatus comprising:

a base pipe;

a pressure settable device configured to set upon an increase in pressure in the base pipe beyond a predetermined limit;

an inflow control device configured to control flow of reservoir fluid into the base pipe, the inflow control device comprising a check valve that is movable from a closed position wherein flow of reservoir fluid into the base pipe through the inflow control device is prevented to an open position wherein flow of the reservoir fluid into the base pipe through the inflow control device is allowed; and a plug that seats in the apparatus to prevent fluid from flowing through the base pipe;

wherein increasing the pressure inside the base pipe beyond the predetermined amount while the plug is seated and the check valve is in the closed position causes the pressure settable device to set; and wherein reducing the pressure in the base pipe to an amount less than surrounding reservoir pressure causes the check valve to move from the closed position to the open position to allow flow of reservoir fluid into the base pipe.

22. Apparatus for use in a wellbore extending into an underground reservoir, the apparatus comprising:

a base pipe;

a packer configured to set upon an increase in pressure in the base pipe;

an inflow control device configured to control flow of fluid into the base pipe from the underground reservoir, the inflow control device comprising a check valve that is movable from a closed position wherein flow of fluid into the base pipe from the underground reservoir is prevented to an open position wherein flow of fluid into the base pipe from the underground reservoir is allowed;

a shroud extending over the inflow control device;

a screen receiving inflow of reservoir fluid to the base pipe;

wherein the inflow control device comprises a collar disposed between the shroud and the base pipe, the collar being movable relative to the base pipe from the closed to the open position, wherein the collar covers a nozzle in the base pipe when the collar is in the closed position; and a plug that seats in the apparatus to prevent fluid from flowing through the base pipe;

wherein increasing the pressure inside the base pipe while the plug is seated and the check valve is in the closed position causes the packer to set;

wherein decreasing the pressure in the base pipe to an amount that is less than the pressure of the fluid in the underground reservoir causes the pressure of fluid in the underground reservoir to move the collar from the closed position to the open position, thereby allowing inflow of reservoir fluid through the screen and into the base pipe via the nozzle.

* * * * *

UNITED STATES PATENT AND TRADEMARK OFFICE

CERTIFICATE OF CORRECTION

PATENT NO. : 7,891,432 B2
APPLICATION NO. : 12/037136
DATED : February 22, 2011
INVENTOR(S) : Anwar Ahmed Maher Assal It is certified that error appears in the above-identified patent and that said Letters Patent is hereby corrected as shown below:

In the Claims:

Column 4, line 54, "in se" should be changed to --pipe--.

Signed and Sealed this
Twenty-first Day of May, 2013

Teresa Stanek Rea
*Acting Director of the United States Patent and Trademark Office*